US006984932B2

(12) United States Patent
Hitzschke et al.

(10) Patent No.: US 6,984,932 B2
(45) Date of Patent: Jan. 10, 2006

(54) DISCHARGE LAMP FOR DIELECTRICALLY IMPEDED DISCHARGES HAVING A CORRUGATED COVER PLATE STRUCTURE

(75) Inventors: Lothar Hitzschke, München (DE); Frank Vollkommer, Buchendorf (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 10/476,142

(22) PCT Filed: Mar. 3, 2003

(86) PCT No.: PCT/DE03/00689

§ 371 (c)(1),
(2), (4) Date: Apr. 5, 2004

(87) PCT Pub. No.: WO03/083898

PCT Pub. Date: Oct. 9, 2003

(65) Prior Publication Data

US 2004/0155571 A1 Aug. 12, 2004

(30) Foreign Application Priority Data

Mar. 28, 2002 (DE) ..... 102 14 156

(51) Int. Cl.
*H01J 65/04* (2006.01)

(52) U.S. Cl. ..... 313/493; 313/594; 313/607; 313/234; 315/56

(58) Field of Classification Search ..... 313/607, 313/594, 234, 491–493; 315/56, 58, 246, 315/260

See application file for complete search history.

(56) References Cited

U.S. PATENT DOCUMENTS

| | | | | |
|---|---|---|---|---|
| 5,604,410 | A | 2/1997 | Vollkommer et al. | |
| 6,348,760 | B1 * | 2/2002 | Vollkommer et al. | 313/493 |
| 6,376,989 | B1 | 4/2002 | Vollkommer et al. | |
| 6,657,392 | B2 * | 12/2003 | Hitzschke et al. | 315/58 |
| 6,762,549 | B2 * | 7/2004 | Hitzschke et al. | 313/493 |
| 2002/0050780 | A1 | 5/2002 | Juestel et al. | |
| 2002/0163311 | A1 | 11/2002 | Hitzschke et al. | |

FOREIGN PATENT DOCUMENTS

| | | |
|---|---|---|
| DE | 100 23 504 | 11/2001 |
| WO | WO 92/02947 | 2/1992 |
| WO | WO 00/21116 | 4/2000 |
| WO | WO 02 27761 | 4/2002 |

* cited by examiner

*Primary Examiner*—Ashok Patel
(74) *Attorney, Agent, or Firm*—Robert F. Clark

(57) ABSTRACT

The invention relates to a discharge lamp having a base plate and a cover which is arranged in an essentially parallel manner thereto and which is corrugated in order to enable light to exit in a homogeneous manner.

15 Claims, 3 Drawing Sheets

DISCHARGE LAMP FOR DIELECTRICALLY IMPEDED DISCHARGES HAVING A CORRUGATED COVER PLATE STRUCTURE

TECHNICAL FIELD

The present invention relates to discharge lamps that are designed for dielectrically impeded discharges and are also designated as silent discharge lamps or dielectric barrier discharge lamps. Such discharge lamps have an electrode set for producing discharges in a discharge medium that is located in a discharge space of the lamp. Provided in this case between at least one part of the electrode set and the discharge medium is a dielectric layer that forms the dielectric impediment. In the case of lamps in which it is fixed whether the electrodes operate as cathodes or anodes, at least the anodes are dielectrically separated from the discharge medium.

PRIOR ART

Such lamps are prior art and have recently been enjoying increasing attention, chiefly because it is possible with the aid of a pulsed mode of operation (U.S. Pat. No. 5,604,410) to achieve relatively high efficiencies that make use as a source of visible light or as a UV radiator seem attractive for various fields of application. Of particular interest in this case are lamps in which the discharge space is located between two generally plane-parallel plates that are denoted below as base plate and as top plate. In this arrangement, at least the top plate is at least partially transparent, being capable, of course, of bearing on its side facing the discharge space a fluorescent material that is not itself transparent in the true sense. Such lamps with a plate-like design are of interest chiefly as flat discharge lamps, for example, for backlighting purposes in the case of displays, monitors and the like.

In order to ensure sufficient stability in the case of relatively large lamp formats, it is possible to use between the base plate and the top plate support elements that are located inside the discharge space and connect the base plate and the top plate to one another. In the outer region, the plates can be connected via a frame that encloses the discharge space and is not denoted here as a support element. The support elements shorten the bending length between the outer edges of the plates in the region of which the frame described can be provided, and thereby improve the stability of the lamp against bending loads and compressive loads. It is also to be borne in mind in this case that silent discharge lamps are frequently filled with a discharge medium exhibiting low pressure such that a generally relatively large part of the external atmospheric pressure bears on the plates.

SUMMARY OF THE INVENTION

Starting from this prior art, the invention is based on the problem of specifying a silent discharge lamp of the type described having improved design.

The invention therefore provides: a discharge lamp having a base plate, a top plate for the light exit, which is at least partially transparent, a discharge space between the base plate and the top plate for holding a discharge medium, an electrode set for producing dielectrically impeded discharges in the discharge medium and a dielectric layer between at least one part of the electrode set and the discharge medium, characterized in that the surface of the top plate facing the discharge space has a corrugated structure, the extremes of the corrugated shape which respectively face the base plate forming supporting projections for supporting the top plate against the base plate, and there resulting, in two mutually nonparallel planes of section perpendicular overall to the top plate, corrugated lines of section of the surface which satisfy the condition:

$$\text{Max}\ ((f'(x+s)-f'(x))/s)\cdot s<\text{Max}\ ((f(x+s)-f(x))/s)$$

when they are denoted in the respective plane of section by f(x) as a function of the parameter x of an x-axis parallel overall to the top plate, the symbol Max respectively denoting the maximum absolute value of the term in the respective bracket for all values x, neglecting the edge regions of the top plate, f'(x) being the first derivative of f(x) with respect to x, and s having the value 2 mm. The values for x are likewise measured in this case in the length unit mm.

The invention further relates to a display device with such a discharge lamp and thus, for example, a flat display screen, a display or/the like.

The invention thus proceeds from a discharge lamp design having a base plate and a top plate, the plate provided for the light exit being designated here as top plate. The base plate can additionally be provided for a light exit, but will generally not be transparent. In addition, the top plate is not necessarily transparent in its entire extent. As a rule, the base plate and the top plate are substantially flat and plane-parallel overall, but can also deviate somewhat from a flat shape, for example, be curved.

The invention is directed to a particular structure of the top plate. The top plate has a surface facing the discharge space that is intended according to the invention to have a corrugated structure. This corrugated structure has the task of making available the extremes or projections of the corrugated shape facing the base plate as supporting projections for supporting the top plate against the base plate. At least a substantial part of these extremes or projections should thus be supported against the base plate (directly or, in some circumstances, also indirectly), or at least be arranged so directly next to the base plate (or an element arranged thereon) as to produce a support function at all events in the case of bending movements occurring in practice.

The corrugated shape is to be described below with the aid of geometric features. Reference is made in this case to relationships between planes or lines and the top plate, that is to say to lines or planes that are parallel overall to the top plate or perpendicular overall thereto. This is to be understood in the sense that the corresponding planes or lines are intended, as it were, to be perpendicular or parallel to an envelope of the top plate, that is to say without taking account of the corrugation. In other words, the corrugation can be removed for these statements by averaging. In addition, it is not precise mathematical details, but a qualitative understanding that is important for the criteria illustrated below.

The top plate structure is intended to be corrugated in at least two directions situated in the plane of the top plate (in the above sense) and not mutually parallel. They are thus not to be of rib-like design, specifically because no corrugation is present in directions situated parallel to ribs. Rather, starting from a supporting projection, this top plate is to stand out from the base plate in all directions of the top plate.

The corrugation in these directions is referred to the surface of the top plate facing the discharge space.

The surface averted from the discharge space can thus be flat or structured otherwise.

In this case, the corrugated structures of the surface of the top plate on the side of the discharge space are to be corrugated in a way that on the one hand is "roundish" and, on the other hand, has at least locally a certain steepness with reference to the plane of the top plate overall.

The "roundness" is to be expressed below by a difference quotient, formed over a finite path s, of the first derivative of a function f(x) that describes the shape of the surface of the top plate on the side of the discharge space in one direction, that is to say results as a line of section of the surface of the top plate on the side of the discharge space with a plane of section perpendicular to the plane of the top plate overall. This difference quotient is thus $$(f'(x+s)-f'(x))/s,$$

which can also be interpreted as the mean value, formed over the path s, of the second derivative of the function f(x). According to the invention, this difference quotient is not to be excessively large. In other words, excessively small radii of curvature of the line of section are not to be produced over the averaging length s.

Structures that are substantially smaller than the averaging length s are not taken into account in this case. The purpose of this feature is, specifically, to exclude prominent edges, corners or tips, which have been shown to impair the homogeneity of the light emission of the top plate. Small instances of roughness that can certainly indicate edges and tips on a very small length scale are, however, unimportant in this case, because the modulations of intensity caused by them are imperceptible, or slightly perceptible, owing to additional diffusing elements or else to the limited resolution of the human eye. Consequently, the criterion outlined takes account only of the change in the first derivative over the path s.

It has emerged, furthermore, for the preferred case of producing a top plate by deep-drawing of glass that in the case of roundish corrugated shapes it is easy to achieve the frequently targeted control of the material thickness of the top plate. It has been shown empirically that in the presence of prominent corners or tips the material thickness can be controlled with much greater difficulty. In particular, it is scarcely possible with such structures to ensure a substantially constant material thickness.

However, with the exception of the edge regions that are less relevant in any case for the homogeneity of the light emission, that is to say the regions where the top plate and the base plate are connected to one another, including the immediate surroundings, the above criterion directed toward the "roundness" is intended in this case to hold for all x values, that is to say along the entire length of the line of section. This holds at least for the typical structures, which are repeated along the length of the line of section as a rule. Of course, a few individual edges or tips or defects can be tolerated, depending on their number and relevance and the individual requirements.

On the other hand, the top plate is not to have any excessively flat gradients next to the supporting projections, so that an adequate height of the discharge space (thus understood in the direction perpendicular to the plane of the top plate) results overall at limited spacings between the supporting projections. In other words, the first derivative of the function f(x) already mentioned is to reach a certain level of absolute value at least in part. This criterion is also detected with the aid of the described averaging length s, and so the difference quotient $$((f(x+s)-f(x))/s)$$

is considered. These two criteria are intended, moreover, to be tuned to one another, which is the case owing to the inequality specified above. The absolute value maxima are respectively used in this case, the starting point being, as mentioned, absolute value maxima within the framework of structures that repeat at least substantially. As already mentioned, the edge regions and their surroundings are omitted in the case of these considerations.

According to the invention, the variable s has the value 2 mm. However, the criterion described preferably also holds for smaller s values of 1.9 mm, better still 1.8 mm, still better 1.7 mm and, with particular preference, 1.6 mm. In particular, s should make up preferably at most twice the material thickness of the top plate if such a material thickness is defined. In the case of a corrugated surface on the side of the discharge space and of a flat surface of the top plate on the side averted from the discharge space, this is not the case, but is so for a top plate corrugated overall and having a substantially constant material thickness. Specifically, it constitutes a preferred aspect of the invention that the criteria, discussed above and in the following, for the function f(x) also hold for the surface of the top plate on the side averted from the discharge space. However, this is an optional requirement.

Otherwise, the two absolute value maxima mentioned are preferably to fulfill absolute criteria in each case, and not only be restricted in relation to one another. The preferred upper limits of 0.6 $mm^{-1}$, 0.45 $mm^{-1}$, 0.4 $mm^{-1}$ and 0.35 $mm^{-1}$, which are increasingly preferred in this sequence, hold for Max $((f'(x+s)-f'(x))/s)$. Conversely, the lower limits 0.1, 0.15, 0.20, likewise preferred in this sequence, hold for Max $((f(x+s)-f(x))/s)$.

Finally, it is preferred for the lines of section to exhibit substantially periodic structures such that the above criteria can be referred to the individual periods.

A particularly favorable form for the function f(x) is the sinusoidal function, this term covering all displacements of the sinusoidal function along the abscissa and the ordinate. The same holds for arbitrary powers of such a sinusoidal function, it being necessary in the case of fractional powers to imagine an ordinate shift that ensures the sinusoidal function has positive values throughout (so that, for example, the square root is defined). Thus, quadratic sinusoidal functions and similar are also included.

Common to these sinusoidal functions and functions derived from a sinusoidal function is that, at least given exponents that are not excessively extreme, they have a favorable combination of a form that is round and at the same time assumes sufficiently large magnitudes of the first derivative between the extremes. The simplest case is, of course, a simple sinusoidal function. These functions are to be tuned to one another in the various directions of the top plate such that period length and phase angle match, and thus a structure corrugated according to the invention in all directions is produced overall.

It has already been pointed out above that small structures of the surfaces of the top plate are not to be detected because of the averaging parameter s. Firstly, small instances of roughness are frequently unavoidable for production reasons, secondly they do not usually damage the homogeneity of light emission, and thirdly they can be utilized as structures that are advantageous for diffusion of the emitted light (and be provided specifically therefor). It is preferred, in particular, that on the surface averted from the discharge space the top plate has microscopic structures that diffuse the light, that is to say the top plate is "rough". These structures are to be substantially smaller than the parameter s in this case.

In a departure from the relevant prior art, in which the support elements are placed as separate glass balls between the plates, the invention also preferably adopts the approach of constructing the support elements as integrated components of the top plate. These are thus projections of the top plate that are directed toward the base plate and are a unipartite component of the top plate. The top plate is preferably already produced with these projections with the aid of a suitable shaping method, for example deep-drawn or compression-molded. However, the projections can also be integrally formed subsequently. It is, however, essential that when assembling the lamp the top plate has supporting projections that are designed in a unipartite fashion with it. The outlay on the positioning and fixing of separate support elements between the plates should then be eliminated during assembly of the lamp. However, for example, it can be sensible for the purpose of fastening the supporting projections on the base plate to provide a connecting element—made from solder glass, for example—between the base plate and the supporting projections.

Furthermore, the invention is based on the idea that a unipartite construction of spacer elements with the base plate, which arises as development from the conventional supporting balls to be connected first to the base plate is more unfavorable because the contact between the support elements and the plate produces shadows in the luminance distribution that impair the homogeneity. It has emerged that these shadows are more pronounced the smaller the distance of the contacts causing the shadows from the light-emitting plane of the top plate. It is therefore regarded as more favorable not actually to avoid such contacts completely, but to arrange them situated as deeply as possible, that is to say remote from the light-emitting side. By this means, the shadows merge to a greater extent in the luminance distribution of the lamp, particularly when diffusers or other elements homogenizing the luminance are also used on the top side of, or above, the top plate. The larger the distance between such diffusers and similar elements and the structures causing shadows, the more effectively it is possible to distribute the shadows two-dimensionally or resolve them again.

When the supporting projections according to the invention are formed by the corrugated structure described, by refraction of light impinging from the discharge space, or by appropriate alignment of the emission characteristics of a fluorescent layer on the outer surface, they ensure an alignment of light into the core region of the supporting projections. It is thereby possible to counteract the shadow produced by the contact with the base plate.

Furthermore, together with a pattern, prescribed by the electrode structure, of individual discharges it is possible to undertake an optimization to a luminance that is as homogeneous as possible in an overall design of the arrangement of supporting projections and of the discharge structure. In addition to the shadow effect of the contact between supporting projection and base plate, it has also specifically to be taken into account that the individual discharge structures typically burn not below, but between supporting projections. Consequently, the maxima of the UV generation are likewise situated between the supporting projections. As a result of the effect of optical deflection, the light can be brought partly from these regions into the regions of the supporting projections so as to produce a relatively homogeneous luminance on the top side of the top plate. Thus, the basic idea of the invention consists at this junction in a departure from the prior art in considering the supporting projections not as disturbances in the luminance, to be homogenized separately, of the discharge structure. Rather, in the case of the invention the supporting projections preferably assume an active role in the light distribution and are taken into account in the overall design exactly as is the discharge distribution, which is likewise inherently inhomogeneous. The aspect of the invention addressed here is brought out more vividly by the exemplary embodiment.

To the extent that this application talks of individual discharges or discharge structures, these statements relate, strictly speaking, to regions prescribed by the design of the lamp, in particular of the electrodes and the supporting projections, in which such individual discharge structures can burn. Depending on the operating state of the lamp, however, variously extended discharge structures are also conceivable in this case within these regions. Thus, the regions need not necessarily be filled entirely with a discharge structure. Above all, the desire can be to influence the size of the discharge structures in conjunction with dimming functions of the lamp. The statements in this application therefore relate to the regions which can be filled to the greatest extent with discharge structures. To the extent that electrode structures are provided for determining preferred positions of discharges, there will generally be a 1:1 correspondence with the discharge regions.

Despite roundness of the corrugated shape, a preferred feature of the invention is to keep the contact surface between the supporting projection and the base surface as small as possible, in particular by virtue of the fact that it results only from bearing by touching. In other words, instances of bonding, solder glass and the like, which would necessarily enlarge the contact surface somewhat, are to be dispensed with as far as possible. For the rest, such additions usually have the disadvantage that they release gases upon heating during lamp production so that extensive pumping operations are required to keep the discharge medium pure. Production is substantially simplified if, in accordance with the invention, such substances are dispensed with. However, it is not excluded in the case of bearing by touching that the supporting projections are pressed slightly into other layers that are required in any case, for example into reflection layers or fluorescent layers on the base plate. A similar statement can hold for a fluorescent coating of the supporting projections themselves.

This bearing purely by touching between supporting projections and base plate generally suffices for the targeted stabilization effect, because mechanical stresses pressing the plates away from one another do not occur, as a rule. This holds, in particular, for the case, which is of most interest technically in any case, in which the discharge lamp is operated with a discharge medium at low pressure. The supporting projections are then pressed against the base plate by the external overpressure.

In the case of the invention, a multiplicity of supporting projections are provided between the base plate and the top plate. The invention therefore differs additionally from the prior art, in which an attempt was made to use the smallest possible number of support elements. The inventors have verified that, given appropriately more frequent support, it is possible to use comparatively thin base plates and top plates such that it is possible to realize a substantial weight saving for the overall lamp. The overall weight of the lamp is, however, of substantial importance for many applications. Moreover, in the case of relatively light plates the mounting method and automatic mounting devices possibly required therefor can be rendered substantially more simple and less expensive. Moreover, it is of course possible to achieve improved stability with a larger number of supporting projections. Furthermore, the processing times during production are shortened, because thinner plate materials and therefore smaller thermal capacitances occur.

In this case, the supporting projections are to be arranged assigned to individual localized discharge regions in the discharge space. It is firstly to be established in this regard that the individual localized discharge structures have appeared with the already mentioned pulsed operating method even without this invention and were able to be permanently localized by creating preferred sites on the electrodes. However, the invention is not restricted to lamps with such preferred sites. Rather, it transpires that the invention itself results in preferred locations between the supporting projections for individual discharge regions, so that the conventional structures, for example nose-like projections on the cathodes, can also be less strongly pronounced. To the extent that individual discharge structures or regions can be produced between the supporting projections according to the invention independently of the possible pulsed operating method, the invention also relates thereto.

The assignment between supporting projections and individual discharge regions is to be present in the invention at least insofar as the individual discharge regions are respectively surrounded by identical patterns of directly adjacent supporting projections. This excludes, of course, discharge regions in the edge region of the discharge lamp, that is to say in the vicinity of the frame or the lateral closure of the discharge vessel. The aim in this case is to design the pattern of the directly adjacent supporting projections around a discharge region together with this discharge region so as to homogenize the luminance here as far as possible. The relatively large number of supporting projections then does not play a disadvantageous role for the homogeneity (compare the above explanations on the overall design of the discharge lamp). Of course, individual supporting projections can be directly adjacent to more than one discharge region, and this will even be the rule.

It is also preferred that the supporting projections for their part are surrounded as far as possible by the same pattern of directly adjacent discharge regions in each case.

Finally, it is preferred for the supporting projections and the discharge regions to alternate along specific directions. The alternating row need not be a row alternating directly one after the other (according to the pattern ababab . . . ). Also included is a row in which two supporting projections or two discharge regions occur regularly one after another as long as each supporting projection and each discharge region has at least one discharge region or at least one supporting projection as its neighbor (that is to say, for example, abbabbabb . . . or aabbaabb . . . ). They need not necessarily be strictly collinear in this direction of the alternating row, but can also be distributed in a somewhat zigzag fashion. Consequently, the overall result is a planar pattern of supporting projections and discharge regions of alternating design, for example a chessboard pattern. Furthermore, it is preferred in the case of strip-like electrodes for adjacent discharge regions situated on one strip side to be respectively separated by supporting projections.

Finally, in the case of this invention preference is given to those discharge lamps that are designed for bipolar operation, in the case of which the electrodes therefore function alternately as anodes and as cathodes. Owing to a bipolar operation, the discharge structures, which are inherently generally asymmetric, are superimposed on one another to form a symmetrical distribution on average over time, for which reason the optical homogenization can be further improved.

BRIEF DESCRIPTION OF THE DRAWINGS

A more concrete description of the invention is given below with the aid of the exemplary embodiment. Individual features disclosed in this case can also be essential to the invention in combinations other than those represented. Moreover, the individual features in the above description and that which follows relate to aspects of the device and of the method of the invention. In detail.

PREFERRED EMBODIMENT OF THE INVENTION

Figure 1:
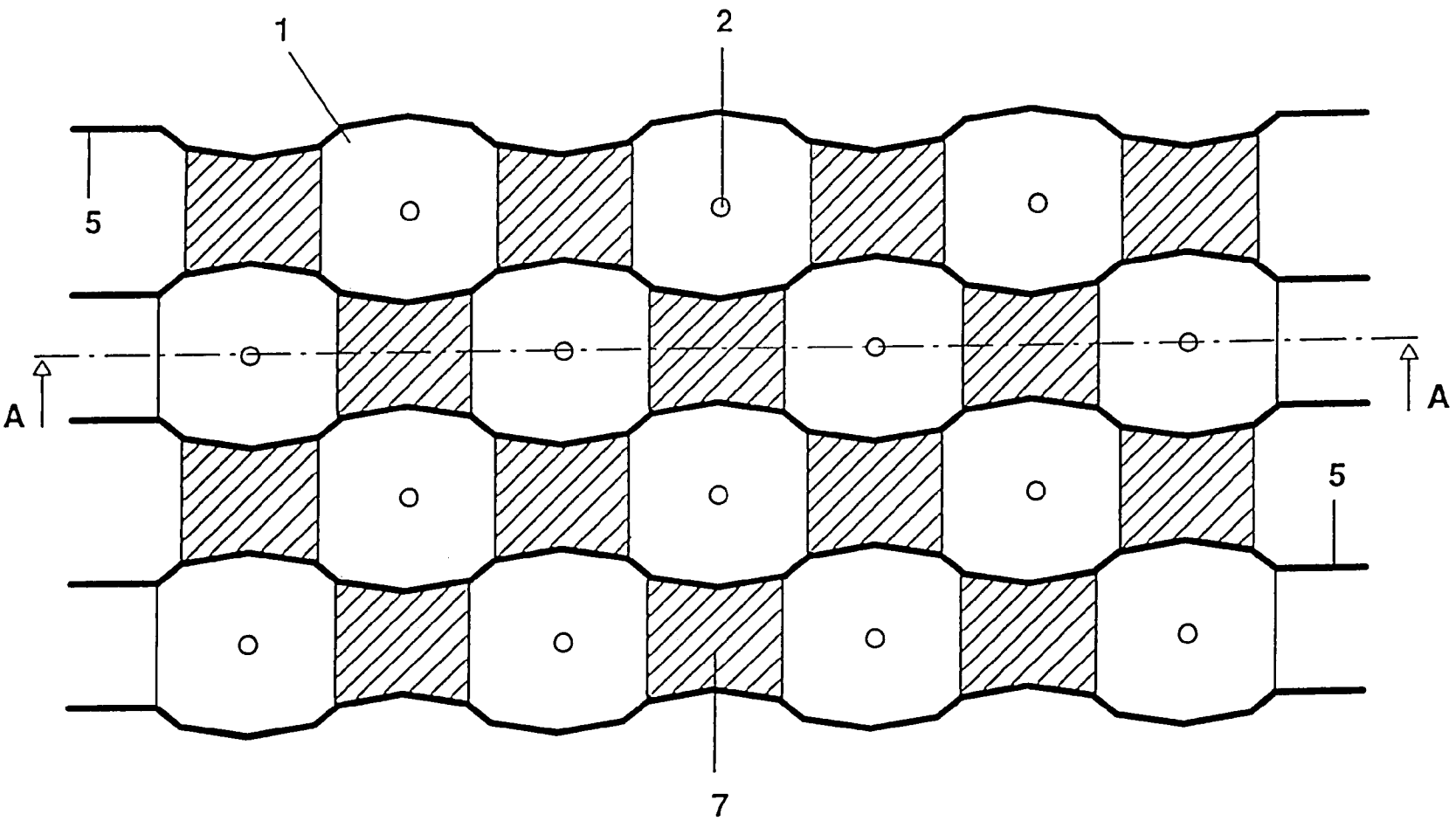
FIG. 1 shows a schematic plan view of an arrangement according to the invention of individual discharges and supporting projections.

FIG. 1 shows a schematic plan view of an arrangement of supporting projections and individual discharge regions that is like a chessboard. In this case, the small circles denoted by 2 correspond to the round extremes, which point downward, that is to say toward the base plate 4, of sinusoidal supporting projections of the top plate 3 situated above in the cross-sectional view (A—A) in FIG. 2*a*.

Figure 2A:
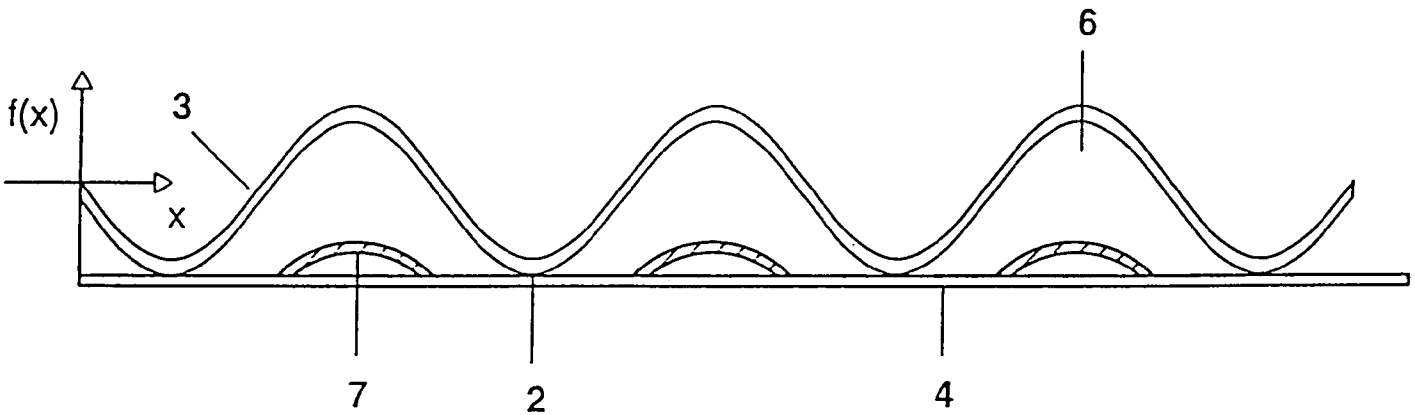
FIG. 2*a* shows a cross-sectional illustration of the arrangement of FIG. 1, along the line A—A in FIG. 1.

FIG. 2*a* shows that along the line A—A in FIG. 1 the top plate 3 has a sinusoidal profile that also occurs identically in other parallel sections through the respective extremes 2 and in orthogonal sections through the extremes 2. The lower "round tips" 2 of the sinusoidal shape bear in a touching fashion against the base plate 4, while the upper "round tips", that is to say the maxima on the sinusoidal shape, respectively rise above the highest regions of the discharge space 6.

The sinusoidal shape illustrated in FIG. 2*a* and FIG. 2*b* can be described with reference to the coordinate system illustrated there as $$f(x)=2\ \mathrm{mm}\cdot\sin(0.42\ \mathrm{mm}^{-1}\cdot x).$$

In this description, therefore, the unit lengths are considered in mm. The result is a period length of 15 mm and an overhead clearance for the discharge space of 4 mm, corresponding to twice the amplitude.

For Max $(f'(x+s)-f'(x))/s$, the value 0.3425 $\mathrm{mm}^{-1}$ holds for s=2.0 mm, and the value 0.3451 $\mathrm{mm}^{-1}$ holds for s=1.6 mm.

Both values therefore correspond approximately to 0.34 $\mathrm{mm}^{-1}$.

For Max $(f(x+s)-f(x))/s$ the value 0.8155 holds for s=2.0 mm, and the value 0.8214 holds for s=1.6 mm. Both values therefore correspond to approximately 0.82. The inequality set up by the invention is thus satisfied. The same holds for the absolute quantitative limits of the dependent claims.

Figure 2B:
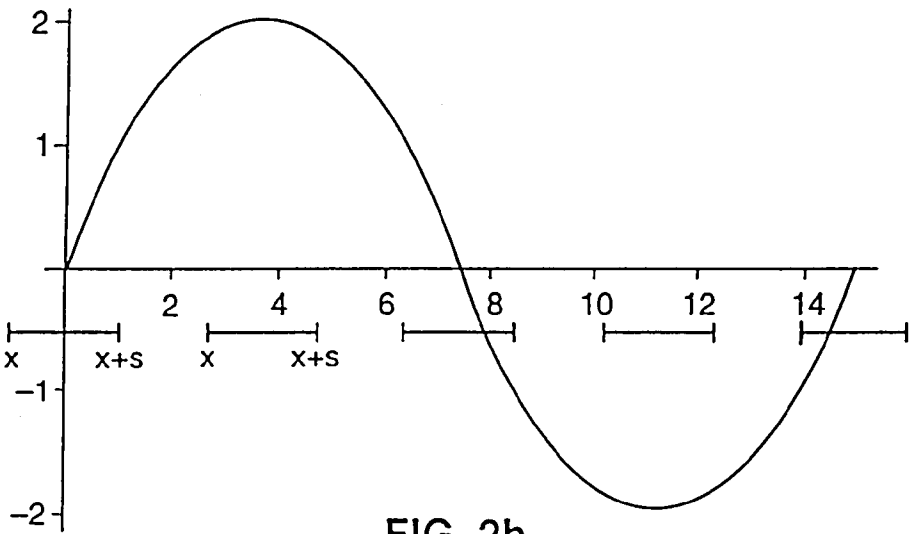
FIG. 2*b* shows an illustration of features of the invention with the aid of the sinusoidal shape of the profile in FIG. 2*a;*

FIG. 2*b* illustrates an enlarged and idealized detail of the top plate. The intervals drawn in further show the path s=2 mm for values of x (that is to say a path between x and x+s) where the respective maxima are reached.

FIG. 2*a* illustrates that this corrugated shape of the top plate 3 offers a good combination between a sufficient steepness in the region of the mathematical points of inflection between extremes, on the one hand, and a round edgeless design of the extremes and of the top plate profile overall, on the other hand. Similar properties would hold, for example, for a quadratic sinusoidal function, in which case the ordinate would then need to be displaced such that the extremes 2 correspond to the value f(x)=0. In addition, the period length would need to be adapted correspondingly. In contrast to this, the invention is not to include angular sawtooth shapes, for example. Specifically, these do not meet the combination requirement, given by the critieron of the characterizing part of claim 1, of "roundness" and "steepness", specifically independently of the gradient of the straight sections between the corners of the sawtooth lines. This criterion takes account precisely of the fact that in the case of lines of section with a relatively flat profile, that is to say functions f(x), requirements that are more stringent are to be placed on roundness and, conversely, more lenient requirements are to be placed on roundness in the case of lines of section with a relatively steep profile. Depending on the type of application and the required space between the supporting projections in relation to the required height of discharge space between the supporting projections, it is possible in each case to include optimal combinations of the two requirements.

In this exemplary embodiment, the top plate 3 is a deep-drawn glass plate with a thickness of 0.8 mm. The contour of the top side of the top plate 3 is therefore shaped largely like the underside of the top plate 3. However, this is not absolutely necessary. The top side of the top plate 3 could also be flat (or have different shapes). In addition to the points of view of the optical effect of the shape of the top plate 3, it is necessary in this case chiefly to consider criteria of favorable manufacturing capability.

Denoted by 5 in FIG. 1 are electrode strips in the case of which there is no difference between anodes and cathodes, which are therefore all separated by a dielectric layer from the discharge space 6 formed between the top plate 3 and the base plate 4. The electrode strips 5 have shapes that run in the form of zigzags or waves and are composed of rectilinear path segments. Short path segments of the electrode strips 5 between directly adjacent supporting projections are inclined relative to the main strip direction and ensure separation of the discharge regions, which are denoted by 7 in FIGS. 1 and 2. If these segments were to be omitted, the discharge regions 7 would just touch. Between these oblique path segments, the electrode strips form indistinct sawtooth shapes in the vicinity of the discharge regions 7 themselves, the tip of the sawtooth being situated in the middle in each case. These electrode shapes are important for localizing individual discharges in the region of the shortest discharge spacing, that is to say between corresponding projecting vertices of the electrode strips 5. An individual discharge of variable extent, which can also be divided into a plurality of discharge structures in some circumstances, will burn in each discharge region 7 in the case of this exemplary embodiment.

The exemplary embodiment illustrates that both the supporting projections with the lower extremes 2, on the one hand, and the discharge structures 7, on the other hand, are surrounded in each case by identical directly adjacent arrangements (the individual discharges or the supporting projections). Only positions arranged at the edge of the discharge lamps are excluded therefrom.

It is to be seen that the line of section A—A illustrated in FIG. 1 runs alternately through supporting projections with lower extremes 2 and discharge structures 7. The illustration in FIG. 2*a* corresponds to this. The rectangular chessboard-like arrangement produces a simple arrangement here with a multiplicity of neighboring directions of these alternating rows, specifically four horizontal rows and seven vertical rows in the detail, drawn in FIG. 1, of a relatively large lamp structure. The individual discharge structures 7 are reproduced in FIG. 1 by shapes that are almost square. In fact, the individual discharges 7 can assume other shapes.

The electrode strips 5 illustrated here additionally have a course which, in addition to locally fixing the individual discharge structures, also exhibits good properties with reference to the dimming capability of the discharges, for which purpose reference is made to the two applications U.S. Pat. No. 6,376,989 and WO 00/21116. The dimming function is attended by a modification of the planar extent of the individual discharge structures 7, such that the latter can also be illustrated in a smaller fashion than in FIGS. 1 and 2*a*. It is to be seen, moreover, that the discharge structures 7, which are arranged between the same electrode strips 5, are separated from one another by the supporting projections. Because of the separating function of the supporting projections the zigzag shape of the electrode strips 5 in this exemplary embodiment is also only comparatively slightly in evidence, specifically with reference to the discharge spacing, that is to say the spacing between the electrode strips 5.

Figure 3:
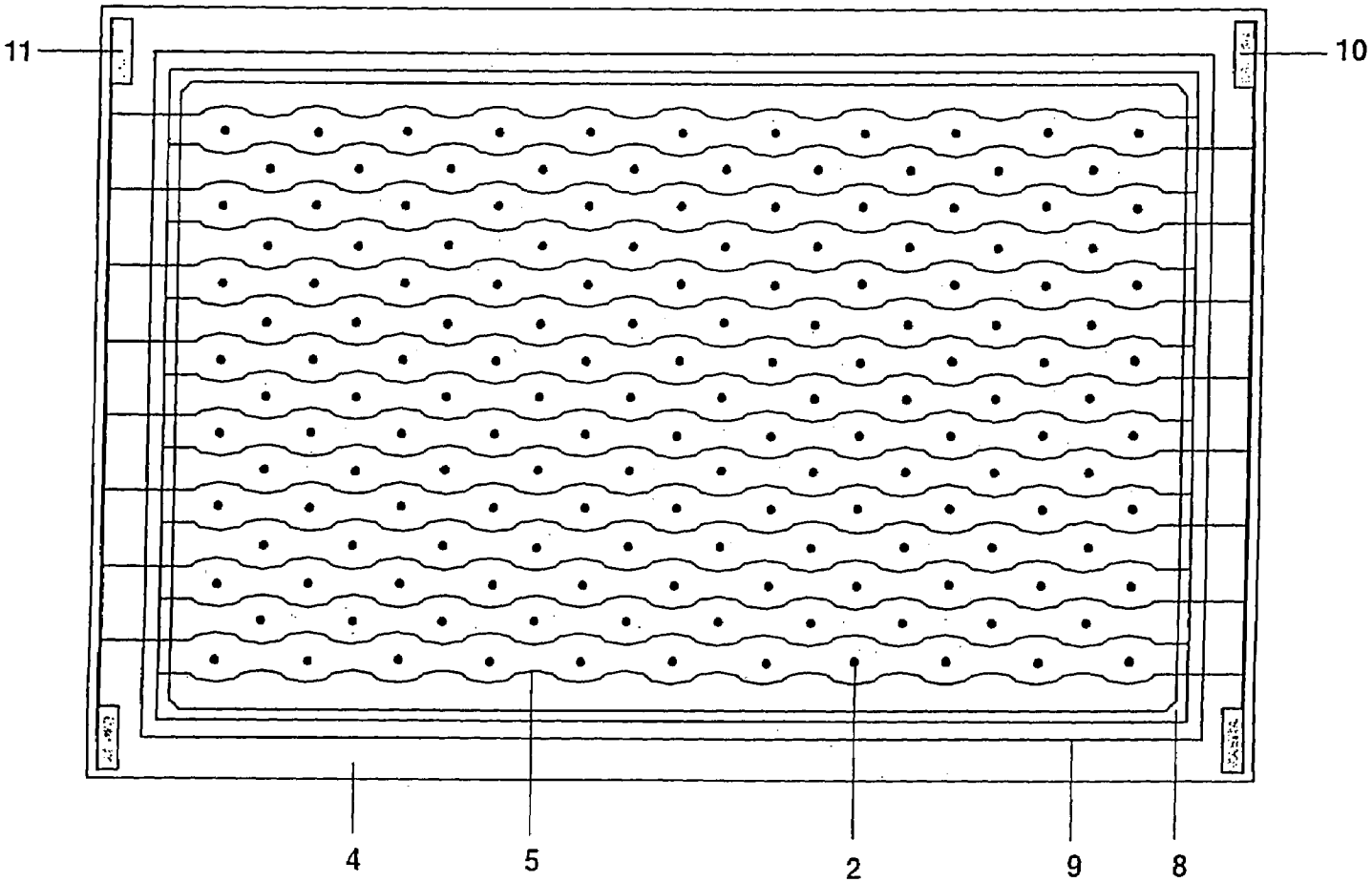
FIG. 3 shows a plan view of an electrode set of a discharge lamp according to the invention, with symbolized contact points of the supporting projections with the base plate, specifically according to the arrangement of FIGS. 1 and 2*a*.

FIG. 3 shows a plan view, corresponding to FIG. 1, of the base plate 4 with the set of electrodes 5. Illustrated here, however, is a complete discharge lamp in the case of which there are provided 21 vertical (in FIG. 3) and 15 horizontal (in FIG. 3) lines with respectively alternating rows of supporting projections with lower extremes 2 and discharge structures 7. For the sake of clarity, the discharge structures 7 are not illustrated, but are seated during operation of the discharge lamp as illustrated in FIGS. 1 and 2*a*. FIG. 3 also shows that the electrode strips 5 are respectively alternately fed to a right-hand collective terminal 10 in FIG. 3 and a left-hand collective terminal 11 in FIG. 3, in order to be connected jointly thereby to an electronic ballast.

FIG. 3 also shows a frame-like structure 8 in the outer region of the base plate 4. Conventionally, use has been made here of glass frames separate from the base and top plates. In this exemplary embodiment, however, it is provided in a way similar to the corrugated design of the supporting projections that the "frame" 8 is likewise a projection of the top plate 3, not, however, running down to a point, but as a rib.

Here, the contact surface of the frame rib 8 with the base plate 4 has a certain width, because it is necessary there to provide a gastight connection between the top plate 3 and the base plate 4, for example by means of a solder glass. In addition, there are no disturbing shadow effects in this region, because it is in any case the edge at which the luminance is already decreasing.

The frame structure 8 is designed as regards its "height" such that the minima of the sinusoidal profile shape of FIGS. 2*a* and 2*b* rest precisely on the base plate 4 in each case. The thickness of solder glass for fastening the frame structure 8 on the base plate 4 must thus be taken into account in dimensioning the frame rib 8 in relation to the supporting projections, which only bear against it. Accurate setting occurs automatically owing to the fact that the solder glass can be deformed during mounting.

Situated outside the frame rib 8 in FIG. 3 is, moreover, a line 9 which shows the limit of the frame. The frame is bent up outside the rib 8. The electrode terminals (with bus structure) 10 and 11 illustrated outside, here, could also be accommodated in a protected fashion below the bent-up part. The fluorescent coating is situated on the side of the top plate 3 facing the discharge space 6, that is to say on the underside of the top plate 3 in FIG. 2*a*, and covers the top plate 3 completely inside the inner frame boundary illustrated in FIG. 3. The supporting projections are therefore also covered with fluorescent material.

Owing to the rounded shape of the contact between supporting projections and base plate 4, the function of separation between the discharge regions can be safeguarded along the same electrode strip 5 better than in the case of a pointed contact.

A high degree of plate stability results from the arrangement of supporting projections that is exceptionally dense by comparison with conventional discharge lamps. Consequently, both the top plate 3 and the base plate 4 are of relatively thin-walled design. In addition, as illustrated in FIG. 3, it is provided that no separate frame is used between the base plate 4 and top plate 3. A drastically reduced outlay on mounting and substantially shortened processing times result from the unipartite design of the supporting projections with the top plate 3.

When, as here, the top plate 3 is coated together with the supporting projections with fluorescent material, the result of this is that the emission characteristics of the visible radiation are inclined so as to produce a brightening of the shadow caused by the contact with the base plate 4. Thus, light is directed from the surroundings into the region above the center of the supporting projection. It is also possible to provide by way of support in this case optically active structures, for example roughened surfaces on the top side or above the top plate 3. These optically active structures can preferably be integrated in the top plate 3 or provided as a separate element.

The supporting projections are respectively surrounded by an arrangement, as uniform as possible, of discharge structures 7. In the case of the exemplary embodiment, this is the case because each supporting projection 1, 2 picks up light contributions from four discharge structures 7 distributed uniformly around it and, apart from the edge of the discharge lamp, the supporting projections 1, 2 do not differ therein.

What is claimed is:

1. A discharge lamp having a base plate (4), a top plate (3) for the light exit, which is at least partially transparent, a discharge space (6) between the base plate and the top plate for holding a discharge medium, an electrode set (5) for producing dielectrically impeded discharges (7) in the discharge medium and a dielectric layer between at least one part of the electrode set (5) and the discharge medium, characterized in that the surface of the top plate (3) facing the discharge space (6) has a corrugated structure, extremes (2) of the corrugated shape which respectively face the base plate forming supporting projections for supporting the top plate (3) against the base plate (4), and there resulting, in two mutually nonparallel planes of section (A—A) perpendicular overall to the top plate (3), corrugated lines of section of the surface which satisfy the condition:

$$\mathrm{Max}((f'(x+s)-f'(x))/s)\cdot s<\mathrm{Max}((f(x+s)-f(x))/s)$$

when they are denoted in the respective plane of section by f(x) as a function of the parameter x of an x-axis parallel overall to the top plate (3), the symbol max respectively denoting the maximum absolute value of the term in the respective bracket for all values x, neglecting the edge regions of the top plate (3), f'(x) being the first derivative of f(x) with respect to x, and s having a value from 1.6 mm to 2 mm.

2. The discharge lamp as claimed in claim 1, in which Max ((f'(x+s)−f'(x))/s) is at most 0.35 $mm^{-1}$.

3. The discharge lamp as claimed in claim 1, in which Max ((f'(x+s)−f'(x))/s) is at most 0.6 $mm^{-1}$.

4. The discharge lamp as claim in claim 1, in which Max ((f(x+s)−f(x))/s) is at least 0.1.

5. The discharge lamp as claimed in claim 1, in which Max ((f(x+s)−f(x))/s) is at least 0.15.

6. The discharge lamp as claimed in claim 1, in which f(x) can be represented by means of a sinusoidal function or a rational power of a sinusoidal function.

7. The discharge lamp as claimed in claim 1, in which, denoting by f(x) the lines of section of the surface of the top plate (3) averted from the discharge space (6) with two mutually nonparallel planes of section (A—A) perpendicular overall to the top plate, the condition is also satisfied for these lines of section f(x) as a function of a parameter of an x-axis, parallel overall to the top plate (3), in the respective planar section (A—A).

8. The discharge lamp as claimed in claim 1, in which the top plate (3) has on its surface averted from the discharge space (6) microscopic structures for diffusing the emitted light.

9. The discharge lamp as claimed in claim 1, in which Max ((f(x+s)−f(x))/s) is at least 0.20.

10. The discharge lamp as claimed in claim 1, in which the supporting projections bear only against the base plate (4).

11. The discharge lamp as claimed in claim 1, in which the surfaces, facing the discharge space (6), of the supporting projections are coated with a fluorescent material.

12. A display device having a discharge lamp as claimed in claim 1, the discharge lamp serving for backlighting the display device.

13. The discharge lamp as claimed in claim 1, in which Max ((f'(x+s)−f'(x))/s) is at most 0.45 $mm^{-1}$.

14. The discharge lamp as claimed in claim 1, in which Max ((f'(x+s)−f'(x))/s) is at most 0.4 $mm^{-1}$.

15. A discharge lamp having a base plate (4), a top plate (3) for the light exit, which is at least partially transparent, a discharge space (6) between the base plate and the top plate for holding a discharge medium, an electrode set (5) for producing dielectrically impeded discharges (7) in the discharge medium and a dielectric layer between at least one part of the electrode set (5) and the discharge medium, characterized in that the surface of the top plate (3) facing the discharge space (6) has a corrugated structure, extremes (2) of the corrugated shape which respectively face the base plate forming supporting projections for supporting the top plate (3) against the base plate (4), and there resulting, in two mutually nonparallel planes of section (A—A) perpendicular overall to the top plate (3), corrugated lines of section of the surface which satisfy the condition:

$$\mathrm{Max}\ ((f'(x+s)-f'(x))/s)\cdot s<\mathrm{Max}\ ((f(x+s)-f(x))/s)$$

when they are denoted in the respective plane of section by f(x) as a function of the parameter x of an x-axis parallel overall to the top plate (3), the symbol Max respectively denoting the maximum absolute value of the term in the respective bracket for all values x, neglecting the edge regions of the top plate (3), f'(x) being the first derivative of f(x) with respect to x, and s is at most twice the material thickness of the top plate (3).

* * * * *